United States Patent [19]

Jayne et al.

[11] 4,016,088

[45] Apr. 5, 1977

[54] HYDRAULIC FLUIDS

[75] Inventors: Gerald John Joseph Jayne; Herbert Frank Askew; Colin John Harrington, all of Swindon, England

[73] Assignee: Castrol Limited, England

[22] Filed: July 22, 1975

[21] Appl. No.: 598,010

Related U.S. Application Data

[62] Division of Ser. No. 508,842, Sept. 24, 1974.

[30] Foreign Application Priority Data

Sept. 25, 1973 United Kingdom ..... 44905/73
Dec. 14, 1973 United Kingdom ..... 58175/73

[52] U.S. Cl. ..... 252/78.3; 252/77; 252/78.1

[51] Int. Cl.[2] ..... C10M 3/46; C10M 3/44

[58] Field of Search ..... 252/78, 49.6, 78.1, 252/78.3; 260/448.8 R

[56] References Cited

UNITED STATES PATENTS

| | | | |
|---|---|---|---|
| 3,308,149 | 3/1967 | Schenck et al. | 252/78 X |
| 3,336,227 | 8/1967 | Gothel et al. | 252/78 X |
| 3,814,691 | 6/1974 | Csejka et al. | 252/78 |
| 3,903,006 | 9/1975 | Elliott et al. | 252/73 X |

*Primary Examiner*—Harris A. Pitlick
*Attorney, Agent, or Firm*—Bacon & Thomas

[57] ABSTRACT

Novel glycol-substituted alkyl silanes useful as components of hydraulic fluids have the general formula:

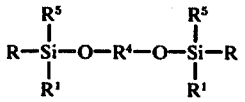

wherein R, $R^1$, $R^4$ and $R^5$ are specified substituents. Hydraulic fluids containing the glycol-substituted alkyl silanes are also described.

18 Claims, No Drawings

HYDRAULIC FLUIDS

This is a division of application Ser. No, 508,842 filed Sept. 24, 1974.

This invention relates to hydraulic fluids containing certain alkyl silane derivatives and particularly to hydraulic fluids containing such derivatives and having high boiling point and vapor lock temperatures.

Hydraulic fluids based on glycol ethers have been used in, for example, vehicle brake and clutch systems for many years and still remain the most commonly used type of fluid. However, specifications of required quality standards laid down by hydraulic systems manufacturers and non-commercial organisations such as the Society of Automotive Engineers and the U.S. Department of Transportation have become progressively more severe. In particular, a need has arisen for fluids having higher boiling points and, more importantly, higher vapour lock temperatures both for the fluid as formulated by the manufacturers and also for the fluid in the presence of water. Glycol ether based fluids are known to be deficient in this respect due to the hydroscopicity of the fluid which results in the absorption of water from the atmosphere. This in turn reduces the boiling point and vapour lock temperature of the fluid and with extended use the water content of the fluid can build up to a level at which the boiling point and vapour lock temperatures are reduced to a dangerous extent. When subjected to heat, e.g. generated by heavy braking, the fluid may boil or vaporise to a sufficient extent to cause a serious brake malfunction.

Hydraulic fluids having low hygroscopicity have been developed, based on glycol esters, to deal with this problem. Such fluids are relatively insensitive to the effect of atmospheric moisture, but are more expensive then glycol ether based fluids and have certain technical disadvantages, e.g. their viscosity properties are inferior to those of glycol ether based fluids. Consequently, use of these low hygroscopicity fluids has been mainly limited to where the desirable properties such as high boiling point and vapour lock temperatures are deemed to outweigh their disadvantages. Other types of water insensitive fluids have also been developed. Nevertheless, manufacturers are still seeking new fluids which combine as many as possible of the desirable properties of both glycol ether based and low hygroscopicity fluids and, desirably, have even higher boiling points and/or vapour lock temperatures than the low hygroscopicity fluids.

Recently, there has emerged a growing tendency in vehicle design to use a single hydraulic system to operate equipment, such as power-steering, shock absorbers and brakes, which hitherto were provided with separate hydraulic systems. This has created serious problems in the formulation of suitable fluids. The mineral oil based fluids hitherto used in power-steering systems and shock absorbers are satisfactory with respect to the nitrile and chloroprene rubber used for the seals and gaskets in such systems but are highly detrimental to the natural and styrene/butadiene rubbers used in the construction of hydraulic brake and clutch systems. This results in excessive swelling of the latter seals which can lead to a serious malfunction of the brake or clutch system. Conversely, the fluids hitherto used in brake and clutch systems, which are normally based on glycols, glycol ethers and/or glycol ether esters, and which have operated satisfactorily in such systems, have a detrimental effect on the nitrile and chloroprene rubber gaskets used in power-steering systems and shock absorbers which can also lead to malfunctioning. In the case of vehicle operation the characteristic of reliability in operation, which is generally desirable in all mechanical devices, is increased in importance to an absolutely essential requirement by virtue of safety considerations. The need has therefore arisen for a fluid which can be used satisfactorily in a central system controlling the operation of a number of different items of equipment.

We have now found certain alkyl silane derivatives which are useful as components of hydraulic fluids, for hydraulic brake and clutch systems and also for central hydraulic systems. These derivatives exhibit improved rubber swell properties with respect to a variety of natural and synthetic rubbers used in the construction of hydraulic systems and they are also relatively water insensitive.

Accordingly the present invention provides alkyl silane derivatives prepared by a process which comprises reacting a di- or tri-chlorosilane of the formula:

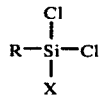

with a diol or polyol of the formula HO—$R^4$—OH and a glycol monoether of the formula:

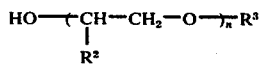

wherein:

a. R is an alkyl group;
b. the or each group $R^2$ is a hydrogen atom or a methyl or ethyl group and each $R^2$ may be the same as or different from any other group $R^2$;
c. $R^3$ is an alkyl group;
d. $R^4$ is the residue of a diol or polyol;
e. n is a integer of from 1 to 10; , and
f. X is a chlorine atom or the group R. In another aspect of the present invention there is provided a hydraulic fluid containing one or more alkyl silane derivatives prepared by the aforesaid process.

In the case of alkyl silane derivatives for use in hydraulic brake and clutch systems it is preferable for the groups R and $R^3$ to be relatively short chain alkyl groups, e.g. containing from 1 to 4, more preferably 1 to 2, carbon atoms, in order to minimize the rubber swelling effect on the seals and gaskets used in such systems. However when used in a central system it may be more desirable to effect a compromise between the requirements, often conflicting, for each of the various seal and gasket materials. In this case some, or all, of the groups R and $R^3$ may be longer chain alkyl groups, e.g. up to 6, or even 8, carbon atoms.

In yet another aspect of the present invention there is provided the process for the preparation of alkyl silane derivatives which comprises reacting a di- or tri-chlorosilane of the formula:

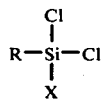

with a diol or polyol of the formula HO—$R^4$—OH and a glycol monoether of the formula:

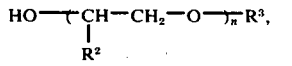

wherein:

a. R is an alkyl group;
b. the or each group $R^2$ is a hydrogen atom or a methyl or ethyl group and each $R^2$ may be the same as or different from any other group $R^2$;
c. $R^3$ is an alkyl group;
d. $R^4$ is the residue of a diol or polyol;
e. *n* is an integer of from 1 to 10; and
f. X is a chlorine atom or the group R.

A dialkyl dichlorosilane may be reacted with a glycol of the formula:

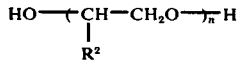

and the glycol monoether. Alternatively an alkyl trichlorosilane may be reacted with a glycol of the formula:

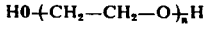

and the glycol monoether.

Reaction of the glycol monoether with the alkyl chlorosilane may be carried out simultaneously in a single stage reaction. Such a single stage reaction may be more convenient but is more difficult to control and therefore sequential reaction is preferred, most preferably employing the glycol in the first stage.

In place of the glycol, a dihydroxy benzene, such as p-hydroxyphenol, or other diols such as neopentyl glycol, or a polyol such as trimethylol propane, pentaerythritol, dipentaerythritol, or a trihydroxy benzene may be used. In this case the product may bear one or more residual hydroxyl groups. Alternatively, sufficient chlorosilane may be used to react with all the hydroxyl groups of the polyol.

In the preparation of the hydraulic fluid components of the present invention, the reaction of a chlorosilane with a hydroxyl group may be carried out in the presence of an acid acceptor to neutralise liberated hydrogen chloride. Especially preferred acid acceptors are tertiary bases such as pyridine. To ensure substantially complete conversion it is usually preferred to use a slight, e.g. 10%, excess of the glycol monoether starting material.

The alkyl silane hydraulic fluid components may be used as an additive, as a base stock or as a component of a blend of base stocks. The proportions employed may therefore vary over a very wide range. When used as a base stock the alkyl silanes derivatives will constitute the bulk of the hydraulic fluid, for example from 75% or 80% to 99% by weight, based on the total weight of the hydraulic fluid. The remainder of the hydraulic fluid may be composed of conventional hydraulic fluid additives, as more fully described hereinafter, and/or small quantities of other hydraulic fluid base-stocks, as also more fully described hereinafter.

When used as a component of a blend of base stocks the total blend of base stocks will likewise constitute the bulk of the hydraulic fluid. In this case, the base stocks may be predominantly one or more alkyl silanes derivatives blended with a lesser quantity of one or more other base stocks, of the type hereinafter described, so as to modify the properties of the alkyl silanes derivatives. Thus the hydraulic fluid may contain, for example 55% to 70% by weight of one or more alkyl silanes derivatives based on the total weight of the hydraulic fluid. Alternatively, one or more other base stocks may be modified by blending with a lesser quantity of alkyl silanes derivatives so that the hydraulic fluid contains, e.g. from 20% to 40% by weight alkyl silane. In addition, a compromise between the properties of the alkyl silanes derivatives and the other fluids may be effected by blending in approximately equal quantities to provide fluids containing from 40% to 55% glycol-substituted alkyl silane.

When used to suppress the sensitivity of hydraulic fluids, and in particular the boiling point and vapour lock temperatures of the fluids, to water the silanes derivatives are preferably used in amounts in the range of 20% to 55%, more preferably 20% to 40%. Alternatively but less preferably, an improvement can also be obtained using lower amounts of the glycol-substituted silanes, e.g. from 0.5% to 15% or 20% by weight based on the total weight of the hydraulic fluids. The bulk of such fluids will be constituted by one or more base stocks as hereinafter described.

When the alkyl silane derivatives are used as a component of a blend of base stocks the resulting hydraulic fluids may contain conventional hydraulic fluid additives in like manner as when the base stock substantially consists of the alkyl silanes derivatives. Similarly, when used as an additive the glycol-substituted alkyl silanes may, if desired, be used in conjunction with conventional hydraulic fluid additives.

Base stocks with which the alkyl silanes derivatives may be blended, or with which they may be used as additives, include glycols, glycol ethers, glycol esters, glycol orthoesters and borate esters. Glycol ether base stocks are well known and suitable examples thereof are those commonly used in hydraulic fluids. The peferred glycol ester base stocks are those having the general formula:

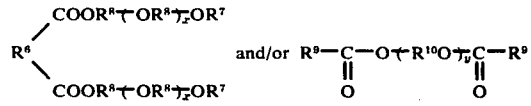

I II wherein $R^6$ is a straight or branched chain alkylene group containing at least 2, preferably 2 to 8, carbon atoms each $R^7$ is the same or different and is an alkyl radical containing from 1 to 4 carbon atoms or a phenyl radical, each $R^8$ is the same or different and is an ethylene, propylene or butylene group, each *x* is the same or different and is 0 of an integer of from 1 to 3, each $R^9$ is the same or different and is an ethyl or methyl group, each $R^{10}$ is the same or different an is an ethylene or propylene group and $y$ is an integer, preferably an integer such that the total number of carbon atoms in the $-(R^{10}O)-_y$ group is from 4 to 12, more preferably 4 to 12, more preferably 4 to 9.

The dicarboxylic acid esters of formula I are described in British Patent Specification No. 1083324. Esters which may suitably be used in the present invention are the succinates, glutarates, adipates, azeiates, sebacates, isosebacates and nylonates of methyl, ethyl, propyl and butyl monoethers of mono, di- and tri-ethylene glycols described in British Patent Specification No. 1083324, the nylonates, especially di mono-methyl ether of diethylene glycol nylonates, being particularly preferred.

The glycol di-esters of formula II are known compounds and the preferred glycol di-esters are the glycol dipropionates described in Britsh Patent Specification No. 1249803. It is preferred that the hydraulic fluids comprise not more than 50% by weight of the glycol di-esters; the remainder, if any, of the carboxylic acid ester component being the esters of formula I.

Numerous varieties of borate ester base stocks are known and these may be depicted by the following general formula:

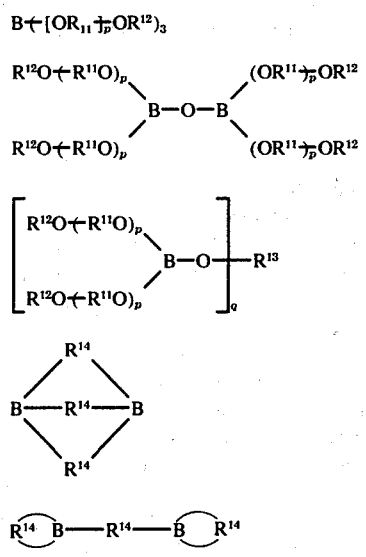

III

IV

V

VI

VII wherein each $R^{11}$ is the same or different and is a straight or branched chain alkylene group, each $R^{12}$ is the same or different and is an alkyl group, each $p$ is the same or different and is an integer of 1 to 8, $q$ is an integer of from 2 to 6, $R^{13}$ is the residue of a di- or poly-hydroxy organic compound having a number of reactive hydroxy groups equal to $q$, and each $R^{14}$ is the same or different and is the residue of a di-hydroxy organic compound which residue is attached to each boron atom via an oxygen atoms.

These borate esters are more fully described in British Patent Specification No. 1341901 to which reference may be made for further details.

Further base stocks which may be used are the glycol orthoesters described in British Patent Specification No. 1330468 having the general formula:

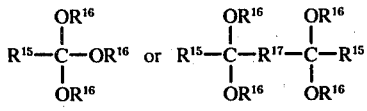

VIII IX wherein $R^{15}$ is a hydrogen atom, an alkyl radical containing from 1 to 5 carbon atoms, or the same as $OR^{16}$; each $R^{16}$ is the same or different and each is an alkyl radical containing from 1 to 4 carbon atoms, an oxyalkylene glycol monoether radical, or a polyoxyalkylene glycol monoether radical containing from 2 to 20 alkylene oxy units, provided that at least one $R^{16}$ is an oxyalkylene glycol monoether radical or a polyoxyalkylene glycol monoether radical; and $R^{17}$ is an alkylene radical containing from 1 to 12 carbon atoms, provided that $R^{15}$ is then the same as $OR^{16}$ or $R^{17}$ is the group $+O-R^{18}O+_z$, wherein each $R^{18}$ is the same or different and each is an alkylene radical containing from 2 to 8 carbon atoms and $z$ is an integer from 1 to 6. Reference may be made to British Patent Spacification No. 1330468 for further details of such glycol orthoesters.

In a particularly preferred embodiment of the present invention the alkyl silanes derivatives are used, as a base stock, in hydraulic fluids also comprising a small amount, e.g. 1% to 10% by weight, of a rubber swell modifier such as an ethylene glycol.

In another particularly preferred embodiment of the present invention the alkyl silanes derivatives are used, either as an additive or as a component of a blend of base stocks, in hydraulic fluids comprising one or more glycol esters of foregoing formulae I and/or II or comprising a mixture of one or more glycol esters of foregoing formula I and/or II with one or more borate esters of foregoing formulae III to VII especially borate esters of formula III.

Typical additives which may be used in, or in conjunction with, the alkyl silanes derivatives are lubricity additives selected from castor oil or castor oil treated in various ways, for example:

Firsts Castor Oil,

Castor Oil to Specification DTD72

Blown castor oil, i.e. castor oil blown with air or oxygen while being heated.

Special Pale Blown Castor Oil, i.e. a similarly blown castor oil.

"Hydricin 4" i.e. a commercially available ethylene/oxide/propylene oxide treated castor oil.

Other lubricity additives which may be incorporated in hydraulic fluids in accordance with the present invention include borate esters e.g. tricresyl borate and phosphorus-containing esters, especially phosphates e.g. tricresyl phosphate.

The hydraulic fluids of the present invention may also include minor proportions of polyoxyalkylene glycols or ethers thereof e.g. those sold by Union Carbide Corporation under the Registered Trade Mark "Ucon", particularly those of the LB and HB series. Suitable examples of these polyoxyalkylene glycols and their ethers and esters are given in British Patent Specification No. 1055641. Other suitable lubricity agents are orthophosphate or sulphate salts of primary or secondary aliphatic amines having a total of from 4 to 24 carbon atoms, dialkyl citrates having an average of from 34½ to 13 carbon atoms in the alkyl groups, aliphatic dicarboxylic acids and esters thereof, specific examples being Diamylamine orthophosphate
Dinonylamine orthophosphate
Diamylamine sulphate
Dinonyl citrate
Di(2-ethyl hexyl)citrate
Polyoxyethylene sebacate derived from a polyoxyethylene glycol of M.W. 200
Polyoxyethylene azelate derived from a polyoxyethylene glycol of M.W. 200
Polyoxyethylene adipate derived from a polyoxyethylene glycol of M.W. 200
Polyoxyethylene/polyoxypropylene glutarate derived from mixed polyoxyglycols of average M.W. of about 200
Glutaric acid
Azelaic acid
Sebacic acid
Succinic acid
Di ethyl sebacate
Di 2-ethyl hexyl sebacate
Di iso octyl azelate Unsaturated aliphatic acids or their salts may also be used e.g. oleic acid or potassium ricinoleate.

Corrosion inhibitors which may be used in the present invention may be selected from heterocyclic nitrogen containing compounds, e.g. benzotriazole and benzotrizole derivatives such as those described in British Patent Specification No. 1061904 or mercapto benzothiazole. Many amines or derivatives thereof are also suitable as corrosion inhibitors, for example di n-butylamine
di n-amylamine
cyclohexylamine
morpholine
triethanolamine and soluble salts thereof e.g. cyclohexylamine carbonate.

Phosphites are also good corrosion inhibitors e.g.

Tri phenyl phosphite
Di isopropyl phosphite and certain inorganic salts may be incorporated e.g. sodium nitrate.

Other additives which may be included are antioxidants such as diarylamines e.g. diphenylamine, p,p'-dioctyldiphenylamine, phenyl-$\beta$-napthylamine or phenyl-$\beta$-naphthylamine. Other suitable antioxidants are those commonly known as hindered phenols which are exemplified by 2,4-dimethyl-6-t-butyl phenol
2,6-di-t-butyl-4-methyl phenol
2,6-di-t-butyl phenol
1,1-bis (3,5-di-t-butyl-4-hydroxyphenyl)-methane
3,3',5,5'-tetra-t-butyl-4-4'-dihydroxydiphenyl
3-methyl-4,6-di-t-butyl phenol
4-methyl-2-t-butyl phenol Yet further additives which may be used are phenothiazine and its derivatives, for example those having alkyl, or aryl, groups attached to the nitrogen atom or to the aryl groups of the molecule.

Other additives which may be used include alkylene oxide/ammonia condensation products as corrosion inhibitors, for example the propylene oxide/ammonia condensation product described in British Patent Specification No. 1249803. Further lubricity additives which may be used are complex esters, such as that sold under the trade name Reoplex 641 and also described in British Patent Specification No. 1249803. Moreover, long chain (e.g. $C_{10-18}$) primary amine corrosion inhibitors and polymerised quinoline resin antioxidants, as described in Specification No. 1249803, may be used, examples of such amines and resins being the commercially available materials Armeen 12D and Agerite resin D respectively.

Conventional additives such as those hereinbefore described are normally employed in small amounts such as 0.05% to 10%, for example, 0.1% to 2% by weight.

We have found that tertiary amines have advantages over primary and secondary amines as corrosion inhibitors such that hydraulic fluids in accordance with the present invention containing tertiary amines show less tendency to gel, especially in the case of hydraulic fluids wherein $R_5$ is as the group $R^1$. Thus, a particularly preferred aspect of the present invention provides hydraulic fluids containing one or more tertiary amines, or derivatives thereof, having the general formula:

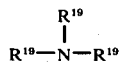

wherein each $R^{19}$ is the same or different and is an alkyl group, preferably containing from 1 to 6 carbon atoms, an aryl, alkaryl or aralkyl group, preferably containing from 6 to 12 carbon atoms or a group having the general formula:

$$\text{-}(R^{20}O)_m R^{21}$$

wherein the, or each, group $R^{20}$ is a straight or branched chain alkylene group, preferably an ethylene, propylene or butylene group, $R^{21}$ is a hydrogen atom or an alkyl group preferably containing from 1 to 6 carbon atoms and $m$ is an integer of from 1 to 6, or any two groups $R^{19}$ may be taken together to form a cyclic system provided that if the nitrogen atom is thereby rendered tertiary the third group $R^{19}$ is absent.

When two of the groups $R^{19}$ in the above general formula are taken together, the cyclic system so formed preferably contains 4 to 6 carbon atoms in the ring. Further hetero atoms such as oxygen and nitrogen may also be contained in the ring as, for example, in tertiary amines derived from morpholine and piperazine respectively; it is desirable however that any further nitrogen hetero atoms should also be tertiary as in 1,4-dimethyl piperazine. Examples of tertiary amines in accordance with the above general formula wherein the two groups $R^{19}$ taken together render the nitrogen atom tertiary, the third group $R^{19}$ thus being absent, are pyridine and quinoline.

Especially preferred tertiary amines for use in the hydraulic fluids of the present invention are triethylamine, triethanolamine, triphenylamine and amines having the formula:

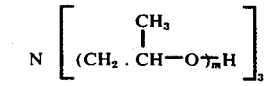

amines of said formula being commercially available under the trade name PROPYLAN A 350.

The tertiary amines may be employed in an amount of from 0.05 to 3.00 percent by weight based on the total weight of the hydraulic fluid.

Regardless of precise composition it is highly desirable that the hydraulic fluids of the present invention have a kinematic viscosity at −40° C. of not more than 5,000 cSt, especially not more than 2,000 cSt. It is also desirable that the hydraulic fluids have a boiling point of at least 260° C.

In a particular aspect of the present invention there is provided a hydraulic system which contains, as the functional fluid, a hydraulic fluid as hereinbefore described.

In a further particular aspect of the present invention there is provided a method of operating a hydraulic system which comprises introducing into the hydraulic system a hydraulic fluid as hereinbefore described and transmitting power by applying pressure to the hydraulic fluid.

The present invention will now be illustrated with reference to the following Examples:

EXAMPLE 1

Triethylene glycol (150g., 1.0m) pyridine (158g., 2.0m), were mixed and the resulting mixture added to dimethyl dichloro silane (258g., 2.0m) dissolved in toluene (3.0l) over a period of 12 minutes. During the addition a dense white precipitate was formed and an exotherm was noted. The temperture of the reaction mixture was kept below 42° C. during the addition.

The reaction mixture was then heated to about 100° C for 4 hours and then allowed to cool. To the resulting first stage product was added a mixture of triethylene glycol monomethyl ether (361g., 2.2m) and pyridine (174g., 2.2m) over a period of 20 minutes during which an exotherm was noted. During the exotherm the temperature was kept below 35° C., but thereafter the reaction mixture was heated to about 100° C., for 4 hours. The resulting product was allowed to cool and was then filtered, the filter cake being washed with further toluene. The solvent (toluene) was removed from the filtrate using a rotary evaporator and the product stripped to 180° C./0.05 torr. The final product (yield 333.0g.) was a clear, very pale yellow liquid containing 11.1% by weight Si and 0.03% by weight Cl (theory 9.5% and 0 respectively).

EXAMPLES 2 to 25

Further preparations were carried out in a similar manner as in Example 1, salient differences being summarised in the following Table 1.

TABLE 1

| | PREPARATION OF BIS-SILANES REACTION MIXTURE COMPONENTS | | | | |
|---|---|---|---|---|---|
| EXAMPLE NO. | DIOL OR POLYOL | GLYCOL MONO-ETHER | ALKL CHLORO SILANE | SOLVENT [D] | PYRIDINE (g) |
| 2 | diethylene glycol 106g | triethylene glycol mono-methyl ether 361g | dimethyl dichloro 258g | 2.5L | 158 + 174 |
| 3 | PEG 200[A] 198g | " | " | 2.5L[B] | —"— |
| 4 | triethylene glycol 750g | triethylene glycol mono-methyl ether | dimethyl dichloro 1290g | 15L | 790 + 870 |
| 5 | 1,2-propylene glycol 76g | triethylene glycol mono-methyl ether 361g | dimethyl dichloro 258g | 2.5L | 158 + 174 |
| 6 | PPG 425[B] 425g | " | " | " | " |
| 7 | PEG 200[A] 297g | diethylene glycol mono-methyl ether 496g | di-methyl dichloro 387g | 3.0L | 237 + 261 |
| 8 | PEG 200[A] 198g | ethylene glycol mono-methyl ether 167g | dimethyl dichloro 258g | 2.5L | 158 + 174 |
| 9 | PEG 200[A] 200g | dipropylene glycol mono-methyl ether 326g | dimethyl dichloro 258g | 2.5L | 158 + 174 |
| 10 | PPG 425[B] 425g | " | " | " | " |
| 11 | PPG 150[C] 300g | dipropylene glycol mono-methyl ether 651g | dimethyl dichloro 516g | 2.5 L | 316 + 348 |
| 12 | 1,1,1-trimethyl-ol propane 134.2g | triethylene glycol mono-methyl ether 541g | dimethyl dichloro 387g | 1.0L + 2.0L | 237 + 261 |

| | REACTION CONDITIONS hrs. | °C | STRIPPING CONDITIONS | | YIELD | ANALYSIS | |
|---|---|---|---|---|---|---|---|
| EXAMPLE NO | FIRST STAGE | SECOND STAGE | °C | torr | (g) | % Si[L,M] | %01.[M] |
| 2 | 4/100 | 4/100 | 190 | 0.05 | 311 | 9.49 (10.2) | 0 (0) |
| 3 | " | " | 190 | 0.05 | 343.8 | 7.74 | 0.14 |

TABLE 1-continued

| | | | | | | | |
|---|---|---|---|---|---|---|---|
| | | | | | | (8.78) | (0) |
| 4 | "[J] | "[K] | 176 | 0.3 | 2508.1 | 8.81 | 0.04 |
| | | | | | | (9.5) | (0) |
| 5 | 4/100 | 4/100 | 171 | 0.1 | 389.9 | 8.72 | 0.04 |
| | | | | | | (10.8) | (0) |
| 6 | " | " | 182 | 0.1 | 777.5 | 5.15 | 0.04 |
| | | | | | | (6.48) | (0) |
| 7 | 4/100 | 4/100 | 180 | 0.05 | 479.7 | 10.69 | 0.03 |
| | | | | | | (10.62) | (0) |
| 8 | " | " | 160 | 0.05 | 322.8 | 12.07 | 0.09 |
| | | | | | | (12.03) | (0) |
| 9 | " | " | 167 | 0.15 | 442.5 | 8.6 | 0.12 |
| | | | | | | (9.22) | (0) |
| 10 | " | " | 183 | 0.4 | 580.7 | 5.9 | 0.11 |
| | | | | | | (6.73) | (0) |
| 11 | " | "— | 146 | 0.1 | 795.9 | 5.8 | <0.1 |
| | | | | | | (10.0) | (0) |
| 12 | 6/100 | 4/100 | 171 | 0.1 | 606.0 | 8.9 | 0.11 |
| | | | | | | (10.6) | (0) |

| EXAMPLE NO | REACTION MIXTURE COMPONENTS: DIOL OR POLYOL | GLYCOL MONO-ETHER | ALKYL CHLORO SILANE | SOLVENT [D] | PYRIDINE (g) |
|---|---|---|---|---|---|
| 13 | Neopentyl glycol 208g | diethylene glycol mono-methyl ether 528g | dimethyl dichloro 516g | 2.5L | 316 + 348 |
| 14 | PEG 200[A] 200g | diethylene glycol mono-ethyl ether 294g | dimethyl dichloro 258g | 2.5L | 158 + 174 |
| 15 | Quinol 110g | triethylene glycol meno methyl ether 361g | " | 2.0L[G] | 158 + 173 |
| 16 | ethylene glycol 62g | diethylene glycol mono-methyl ether 528g | monomethyl trichloro 299g | 2.5L | 158 + 348 |
| 17 | neopentyl glycol 104g | " | " | 3.0L | " |
| 18 | " | " | " | 2.5L | " |
| 19 | 1.2-propy-lene glycol 76g | " | " | 2.5L[H] | " |
| 20 | PPG 150 300g. | triethylene glycol mono-methyl ether 722g. | dimethyl dichloro 516 g. | 2.5L | 316 + 348 |
| 21 | EG 124g. | " | " | 2.5L[E] | " |
| 22 | triethy-lene glycol 300g. | " | " | 2.5L[P] | 484[N] + 532 |
| 23 | PEG 200g. | diethylene glycol mono-ethyl ether 132g dipropylene glycol mono-methyl either 148g. | dimethyl dichloro 258g | 2.5L | 158 + 174 |
| 24 | triethy-glycol 300g | triethylene glycol mono-methyl ether 820g | dimethyl dichloro 516g | 1.5L | None[Q] |
| 25 | 1,1,1, trimeth-ylol propane 134g. | diethylene glycol mono-methyl ether 792g | mono-methyl trichloro 448.5g | 1.0L + 2.0L | 237 + 521 |

| EXAMPLE NO | REACTION CONDITIONS: FIRST STAGE | SECOND STAGE | STRIPPING CONDITIONS: °C | torr | YIELD (g) | ANALYSIS: %Si[L] | %Cl[M] |
|---|---|---|---|---|---|---|---|
| 13 | 4/100 | 4/100 | 152 | 0.5 | 491.8 | 8.22 (12.3) | <0.1 (0) |
| 14 | " | " | 165 | 0.05 | 462.4 | 5.3 (9.65) | <0.1 (0) |
| 15 | 4/100 | 4/100 | 180 | 481.4 | 13.1 | 0.16 (10.2) | (0) |
| 16 | 4/100 | 4/100 | 188 | 0.1 | 340.7 | 9.08 (9.0) | 0.1 (0) |

TABLE 1-continued

| | | | | | | | |
|---|---|---|---|---|---|---|---|
| 17 | " | " | 190 | 0.1 | 238.3 | 7.5 (8.45) | <0.05 (0) |
| 18 | " | " | 174 | 0.1 | 440.9 | 8.41 (8.44) | 0.05 (0) |
| 19 | " | " | 152 | 0.02 | 456.9 | 9.61 (8.8) | 0.07 (0) |
| 20 | " | —" | 160 | 0.1 | 653.3 | 10.1 (9.5) | <0.1 (0) |
| 21 | " | " | 177 | 0.1 | 675.4 | 10.7 (11.1) | <0.1 (0) |
| 22 | 4/80 | 4/80 | 170 | 0.5 to 1.0 | 798.7 | 6.8 (9.5) | 0.13 (0) |
| 23 | 4/100 | 4/100 | 169 | 0.05 | 348.8 | 9.77 (9.65) | <0.1 (0) |
| 24 | " | 12/100 | 170 | 0.1 | 895.0 | 7.5 (9.5) | <0.1 (0) |
| 25 | 6/100 | 4/100 | 190 | 0.1 | 650.4 | 5.6 (8.25) | <0.1 (0) |

FOOTNOTES TO TABLE 1

A PEG 200 is a commercially available mixture of polyethylene glycols having an average molecular weight of about 200.

B PPG 425 is a commercially available mixture of polypropylene glycols having an average molecular weight of about 425

C PPG 150 is a commercially available mixture of polypropylene glycols having an average molecular weight of about 150.

D Toluene, except in examples 12 and 25 when diethylene glycol diether (1.OL) used initially and a further 2.OL of toluene added prior to second stage.

E Further 0.5L added during second stage to aid stirring.

F Further 0.15L added during second stage to aid stirring

G Quinol/pyridine mixture dissolved in to silane.

H Further 0.25L toluene added during second stage to aid stirring.

J Glycol/pyridine mixture added to silane over 1¾ hr.

K Glycol monoether/pyridine mixture added to 1st stage over 2 hrs.

L Due to difficulties in the elemental analysis of organic silicon compounds values obtained for Si content are commonly low.

M Calculated figures in parenthesis.

N N,N-dimethylaniline used in place of pyridine.

P Carbon tetrachloride used in place of toluene.

Q HCl blown out with $N_2$.

IR Spectra of the products of the foregoing examples were all found to be consistent with the expected product being obtained.

To determine the suitability of the products of the foregoing examples for use in hydraulic fluids the following tests were carried out.

a. Kinematic viscosities at −40°, in centistokes, were measured in the manner set forth in the SAE J1703c specification.

b. Samples were subjected to the D.O.T. Humidity test according to the procedure set forth in the FMVSS 116 specification and the vapour lock temperatures of the samples were measured. The vapour lock temperatures were determined in the manner described in British Patent Specification No. 1341901.

c. Rubber Swell properties were measured by placing 1 inch square by 3 mm. thick rubber specimens in 60 ml jars each containing 50 ml test fluid for a period of 3 days during which the temperature was maintained at 70° C. for the nitrile and natural rubber specimens and at and 120° C. for the styrene/butadiene rubber specimens. After the test, the percentage volume increase of each of the rubber specimens was measured.

The results of thest tests are set out in the following Table 2. In addition, the hydrolytic stability of a number of products were tested in accordance with the Water Tolerance tests as set out in the SAE J1703c specification, all products so tested satisfying the stability standards required by this test.

TABLE 2

| Product Tested Example No. | Viscosity (−40°) | Rubber Swell: Natural rubber | Rubber Swell: Styrene/Butadiene rubber | Rubber Swell: Nitrile Rubber | Wet Vapour Lock Temperatures (° C) |
|---|---|---|---|---|---|
| 1 | 829 | ~5 | ~21 | ~16 | 215 |
| 2 | 321 | 8.2 | 32.8 | 33.8 | 249 |
| 3 | 1993 | 3.1 | 12.7 | 13.0 | |
| 4 | 765 | 4.8 | 17.0 | 18.8 | |
| 5 | (low) | 12.4 | 37.3 | 39.0 | 235 |
| 6 | 4172 | 8.8 | 18.5 | 7.3 | 176 |
| 7 | 1832 | 4.3 | 12.1 | 6.8 | 226 |
| 8 | 1549 | 4.9 | 12.5 | 6.0 | 174 |
| 9 | 1712 | 16.1 | 22.5 | 5.5 | 212 |
| 10 | 16439 | 17.6 | 21.0 | −5.0 | 237 |
| 11 | 362.3 | 49.7 | 47.1 | 3.6 | |
| 12 | 515.3 | 23.8 | 39.6 | 33.0 | 225 |
| 13 | 77.5 | 35.5 | 59.7 | 38.9 | 187 |
| 14 | 1015 | 10.8 | 21.7 | 11.7 | |
| 15 | 2261 | 5.3 | 23.9 | 32.5 | |
| 16 | 383 | 4.3 | 15.0 | 23.7 | |
| 18 | 249 | 9.5 | 25.1 | 42.8 | |
| 19 | 589 | 12.8 | 6.2 | 21.7 | |
| 20 | 379 | 11.6 | 24.9 | 26.4 | 230 |
| 21 | 247 | 11.6 | 32.1 | 39.3 | 247 |

TABLE 2-continued

| Product Tested Example No. | Viscosity (−40°) | Rubber Swell Natural rubber | Styrene/ Butadiene rubber | Nitrile Rubber | Wet Vapour Lock Temperatures (° C) |
|---|---|---|---|---|---|
| 22 | | 10.9 | 19.0 | 20.8 | 230 |
| 23 | | 7.5 | 16.9 | 6.4 | 201 |
| 24 | 780 | 4.7 | 13.4 | 22.6 | |
| 25 | 986 | 6.5 | 13.6 | 21.5 | 208 |

We claim:

1. An essentially chlorine free hydraulic fluid containing alkyl silane derivatives in an amount up to 99% by weight, the remainder being selected from conventional hydraulic fluid additives, conventional hydraulic fluid base stocks and mixtures thereof, said alkyl silane derivatives being prepared by a process which comprises reacting a di- or tri-chlorosilane of the formula:

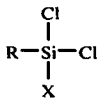

with a diol or polyol and a glycol monoether of the formula:

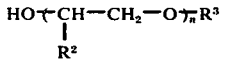

wherein:

a. R is an alkyl group;
b. the or each group $R^2$ is a hydrogen atom or a methyl or ethyl group and each $R^2$ may be the same as or different from any other group $R^2$;
c. $R^3$ is an alkyl group;
d. $n$ is an integer of from 1 to 10; and
e. X is a chlorine atom or the group R.

2. A hydraulic fluid as claimed in claim 1 wherein the alkyl silane derivatives are present as a base stock in an amount of from 75 to 99% by weight based on the total weight of the hydraulic fluid.

3. A hydraulic fluid as claimed in claim 2 which contains one or more conventional hydraulic fluid additives in an amount of from 0.05 to 10% by weight based on the total weight of the hydraulic fluid.

4. A hydraulic fluid as claimed in claim 1 wherein the alkyl silane derivatives are present as a base stock component in an amount of from 55% to 70% by weight based on the total weight of the hydraulic fluid.

5. A hydraulic fluid as claimed in claim 1 wherein the alkyl silane derivatives are used as a base stock component in an amount of from 20 to 55% by weight based on the total weight of the hydraulic fluid.

6. A hydraulic fluid as claimed in claim 5 wherein the alkyl silane derivatives are used in an amount of from 20 to 40% by weight based on the total weight of the hydraulic fluid.

7. A hydraulic fluid as claimed in claim 1 additionally containing at least one of the borate esters having the general formulae:

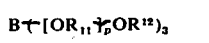

III

-continued

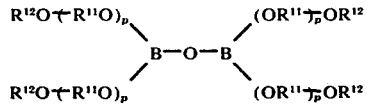

IV

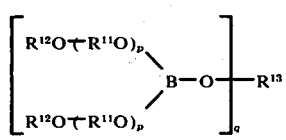

V

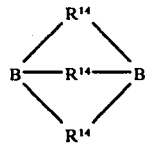

VI

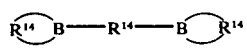

VII wherein each $R^{11}$ is the same or different and is a straight or branched chain alkylene group, each $R^{12}$ is the same or different and is an alkyl group, each $p$ is the same or different and is an integer of 1 to 8, $q$ is an integer of from 2 to 6, $R^{13}$ is the residue of a di- or poly-hydroxy organic compound having a number of reactive hydroxy groups equal to $q$, and each $R^{14}$ is the same or different and is the residue of a di-hydroxy organic compound which residue is attached to each boron atom via an oxygen atom; a glycol ester having the general formula:

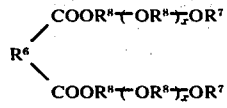

I and/or

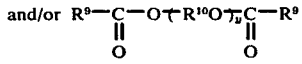

II wherein $R^6$ is a straight or branched chain alkylene group containing at least 2 carbon atoms, each $R^7$ is the same or different and is an alkyl radical containing from 1 to 4 carbon atoms or a phenyl radical, each $R^8$ is the same or different and is an ethylene, propylene or butylene group, each $x$ is the same or different and is 0 or an integer of from 1 to 3, each $R^9$ is the same or different and is an ethyl or methyl group, each $R^{10}$ is the same or different and is an ethylene or propylene group and $y$ is an integer such that the total number of carbon atoms in the group $(R^{10}O)_y$ is 4 to 12; a glycol or a glycol ether, or a mixture thereof.

8. A hydraulic fluid as claimed in claim 1 which contains from 0.05 to 3.00 percent by weight of one or more tertiary amines, or derivatives thereof, having the general formula:

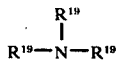

wherein each $R^{19}$ is the same or different and is an alkyl group, an aryl, alkaryl or aralkyl group, or a group having the general formula: $-(R^{20}O)_m R^{21}$ wherein the, or each, group $R^{20}$ is a straight or branched chain alkylene group, $R^{21}$ is a hydrogen atom or an alkyl group and *m* is an integer of from 1 to 6, or any two groups $R^{19}$ may be taken together to form a cyclic system provided that if the nitrogen atom is thereby rendered tertiary the third group $R^{19}$ is absent.

9. A hydraulic fluid as claimed in claim 1 containing alkyl silane derivatives prepared by the desired process wherein the reaction of the di- or tri-chlorosilane with the diol or polyol and glycol monoether is carried out simultaneously in a single stage reaction.

10. Hydraulic fluid as claimed in claim 1 containing alkyl silane derivatives prepared by the described process wherein the reaction of the di- or tri-chlorosilane with the diol or polyol and glycol monoether is carried out as a two stage reaction.

11. A hydraulic fluid as claimed in claim 10 containing alkyl silane derivatives prepared by the described process wherein the first stage of said two stage reaction is the reaction of the di- or tri-chlorosilane with the diol or polyol.

12. A hydraulic fluid as claimed in claim 1 containing alkyl silane derivatives prepared by the described process wherein the reaction is carried out in the presence of an acid acceptor to neutralize liberated hydrogen chloride.

13. A hydraulic fluid as claimed in claim 1 containing alkyl silane derivatives prepared by the described process wherein the di- or tri-chlorosilane is reacted with a glycol or a dihydroxy benzene.

14. A hydraulic fluid as claimed in claim 1 containing alkyl silane derivatives prepared by the described process wherein the di- or tri-chlorosilane is reacted with neopentyl glycol.

15. A hydraulic fluid as claimed in claim 1 containing alkyl silane derivatives prepared by the described process wherein the di- or tri-chlorosilane is reacted with trimethylol propane, pentaerythritol, dipentaerythritol or a tri-hydroxy benzene.

16. A hydraulic fluid as claimed in claim 1 containing alkyl silane derivatives prepared by the described process wherein a dialkyl dichlorosilane is reacted with a glycol of the formula

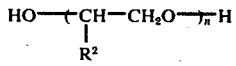

and the glycol monoether.

17. A hydraulic fluid as claimed in claim 1, containing alkyl silane derivatives prepared by the described process wherein an alkyl trichlorosilane is reacted with a glycol of the formula $HO-(CH_2-CH_2-O)_n-H$ and the glycol monoether.

18. An essentially chlorine free hydraulic fluid containing alkyl silane derivatives in an amount up to 99% by weight, the remainder being selected from conventional hydraulic fluid additives of the group consisting of rubber swell modifiers lubricity additives, corrosion inhibitors and antioxidants, and conventional hydraulic fluid base stocks of the group consisting of glycols, glycol ethers, glycol esters, glycol orthoesters and borate esters, and mixtures thereof, said alkyl silane derivatives being prepared by a process which comprises reacting a di- or tri-chlorosilane of the formula:

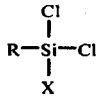

with a diol or polyol and a glycol monoether of the formula:

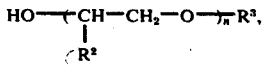

wherein:

a. R is an alkyl group;
b. the or each group $R^2$ is a hydrogen atom or a methyl or ethyl group and each $R^2$ may be the same as or different from any other group $R^2$;
c. $R^3$ is an alkyl group;
d. *n* is an integer of from 1 to 10; and
e. X is a chlorine atom or the group R.

* * * * *